US007531761B2

(12) United States Patent
Carson et al.

(10) Patent No.: US 7,531,761 B2
(45) Date of Patent: May 12, 2009

(54) ELECTRICAL SWITCHING APPARATUS AND INTERLOCK ASSEMBLY THEREFOR

(75) Inventors: Eddie D. Carson, Cleveland, TN (US); Douglas R. Bender, Cleveland, TN (US); Brendan A. Foley, Cleveland, TN (US); Mitchell L. Murray, Cleveland, TN (US); Douglas S. Self, Cleveland, TN (US); Richard D. Prohaska, Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 289 days.

(21) Appl. No.: 11/673,772

(22) Filed: Feb. 12, 2007

(65) Prior Publication Data

US 2008/0190747 A1 Aug. 14, 2008

(51) Int. Cl.
*H01H 9/20* (2006.01)

(52) U.S. Cl. ..... 200/50.12; 200/50.02

(58) Field of Classification Search ... 200/50.01–50.06, 200/50.11, 50.12, 50.19, 401; 361/605–609, 361/615, 616

See application file for complete search history.

(56) References Cited

U.S. PATENT DOCUMENTS 4,190,222 A 2/1980 Appleton et al.
6,066,814 A * 5/2000 Smith et al. ..... 200/50.24
6,373,009 B1 4/2002 Prohaska et al.
6,545,859 B2 * 4/2003 Leccia ..... 200/50.12
6,998,549 B1 * 2/2006 Bender et al. ..... 200/50.12
7,348,510 B1 * 3/2008 Foley et al. ..... 200/293

* cited by examiner

*Primary Examiner*—Elvin G Enad
*Assistant Examiner*—Marina Fishman
(74) *Attorney, Agent, or Firm*—Martin J. Moran

(57) ABSTRACT

An interlock assembly for a safety switch includes a linkage. A first end of the linkage is coupled to the operating handle of the safety switch in order that moving the operating handle results in a corresponding movement of the second end of the linkage into and out of an aperture in a bracket member. The bracket member is movably coupled to the safety switch enclosure by a fastening mechanism. When the cover of the safety switch is disposed in its open position, the bracket member is disposed in a first position preventing the second end of the linkage from entering the aperture and resisting undesired movement of the operating handle. When the cover is closed position, the bracket member is moved to a second position corresponding to the second end of the linkage being receivable by the aperture in order that the operating handle is movable.

20 Claims, 5 Drawing Sheets

4
26
20
24
12
22
48′
6
28
ON
16
OFF
34
46′
30
204
ON
10
14
48′
8
202
18
18
18
138
140
38
142
132
142
144
136
140
206
48
102
114
130
36
46
134
210
208
100
24′
104
106
108
110
112
220
218
214
22′
308
28′
200
300
20′
122

2
126
128
32
124
120
128
126

ELECTRICAL SWITCHING APPARATUS AND INTERLOCK ASSEMBLY THEREFOR

CROSS-REFERENCE TO RELATED APPLICATION

This application is related to commonly assigned, concurrently filed: U.S. patent application Ser. No. 11/673,753, filed Feb. 12, 2007, now U.S. Pat. No. 7,348,510, entitled "Safety Switch, and Enclosure and Electrical Connector Assembly Therefor".

BACKGROUND OF THE INVENTION

1. Field of the Invention

The invention relates generally to electrical switching apparatus and, more particularly, to interlock assemblies for safety switches.

2. Background Information

Safety switches are used in electrical power distribution systems in order to electrically isolate a load or a portion of a power circuit.

Typically, safety switches include an operating mechanism housed within an enclosure, such as a sheet metal cabinet. The operating mechanism includes an operating handle, which typically has either a single-throw configuration, in which the operating handle is operable between two positions (e.g., an ON position and an OFF position), or a double-throw configuration, in which the operating handle has three positions (e.g., a first ON position, a central OFF position, and a second ON position). A more detailed description of the components of safety switches and the operation thereof is provided, for example, in U.S. Pat. No. 6,373,009.

Safety switches are sometimes employed as mechanisms for disconnecting and transferring power that is provided, for example, from a primary power source (e.g., utility service) to a secondary or back-up source (e.g., a generator), for example, in the event that power from the primary power source is interrupted (e.g., a power outage). Such safety switches are sometimes of the aforementioned double-throw variety, with the first ON position corresponding to power being provided to a residence or commercial facility by the primary power source. Following the interruption in primary power, the operating handle can be moved to the second ON position in order that power is supplied to the residence or commercial facility by the generator. More specifically, the safety switch typically includes a number of electrical connectors for receiving conductors (e.g., electrical cables) that extend from the generator. Thus, in a typical power outage scenario, the safety switch operating handle is first turned to the OFF position, and the electrical cables are connected from the generator to the electrical connectors of the safety switch. Connecting the cables when the operating handle is in the OFF position ensures that the safety switch is not energized when the connection is being made, and thereby avoids potential injury. Then, once the electrical cables are safely connected, the operating handle is then turned to the second ON position, in order to source power from the generator.

It is desirable to restore power as quickly as possible in response to a power outage. Accordingly, the electrical connectors of the safety switch are preferably structured to facilitate for the relatively quick and easy connection of the generator cables. To meet this need, prior proposals have employed quick-connect type electrical connectors such as, for example and without limitation, Cam-Lock® and Posi-Lok™ connectors. Cam-Lock® and Posi-Lok™ connectors are available, for example, from Crouse-Hinds Molded Products of LaGrange, N.C. However, known safety switch designs have positioned such quick-connect connectors in an exposed (e.g., outside the safety switch enclosure) or readily accessible position. This presents a serious safety concern.

It is, therefore, desirable to provide a safety switch having improved safety features. Specifically, it is desirable to resist the possibility of unintentionally connecting the generator cables when the safety switch is energized (e.g., the operating handle is in the first ON position or the second ON position).

There is, therefore, room for improvement in electrical switching apparatus, such as safety switches.

SUMMARY OF THE INVENTION

These needs and others are met by embodiments of the invention, which provide an interlock assembly for the enclosure of electrical switching apparatus such as, for example, safety switches, which includes a movable bracket member having an aperture structured to receive and block a linkage when a cover of the safety switch enclosure is closed and open, respectively, thereby permitting and prohibiting operation of the safety switch when the cover of the safety switch is closed and open, respectively.

As one aspect of the invention, an interlock assembly is provided for an electrical switching apparatus including an enclosure and an operating handle. The enclosure has a plurality of sidewalls, an interior, an exterior, and at least one cover. Such cover has an open position in which the interior of the enclosure is accessible from the exterior of the enclosure, and a closed position in which the interior of the enclosure is substantially inaccessible. The operating handle is operable among a plurality of positions. The interlock assembly comprises: a linkage including a first end and a second end, the first end of the linkage being structured to be coupled to the operating handle in order that movement of the operating handle results in a corresponding movement of the second end of the linkage; a bracket member including an aperture, the aperture being structured to receive the second end of the linkage; and at least one fastening mechanism structured to movably couple the bracket member to the enclosure. The bracket member is movable between a first position corresponding to the bracket member being structured to prevent the second end of the linkage from entering the aperture of the bracket member in order to resist undesired movement of the operating handle, and a second position corresponding to the second end of the linkage being structured to be receivable by the aperture in order that the operating handle is movable. When the at least one cover is disposed in the open position, the bracket member is disposed in the first position, and when such cover is disposed in the closed position, the bracket member is disposed in the second position.

The bracket member may comprise a first planar portion structured to be substantially parallel with respect to a corresponding one of the sidewalls of the enclosure, and a second planar portion extending substantially perpendicularly outwardly from the first planar portion and being structured to extend substantially perpendicularly outwardly with respect to the corresponding one of the sidewalls of the enclosure. The aperture of the bracket member may be disposed in the second planar portion. The first planar portion may have a first end structured to extend toward the exterior of the enclosure, a second end disposed opposite and distal from the first end, and at least one elongated opening disposed between the first end and the second end. Such elongated opening may be structured to receive a corresponding one of the at least one fastening mechanism. The corresponding one of the sidewalls of the enclosure may have an edge, and the first end of the first planar portion of the bracket member may include a protrusion wherein, when the bracket member is disposed in the first position, the protrusion is structured to extend beyond the edge of the corresponding one of the sidewalls of the enclosure and, when the at least one cover of the enclosure is moved from the open position toward the closed position, the protrusion and the bracket member are structured to be moved by such cover from the first position toward the second position.

The aperture of the bracket member may be a first aperture, and the bracket member may further include a second aperture. The first aperture may be structured to receive the second end of the linkage and, when the at least one cover of the enclosure is disposed in the closed position and the second end of the linkage is disposed in the first aperture, the second aperture may be structured to receive a portion of such cover in order to fasten such cover in the closed position. The fastening mechanism may include a bias member and a fastener having a shaft, wherein the bias member comprises a number of coils and a biasing arm, wherein the shaft of the fastener is disposed through the coils, and wherein the biasing arm engages the aperture of the bracket member, thereby biasing the bracket member toward the first position.

As another aspect of the invention, an electrical switching apparatus comprises: an enclosure including a back panel, sidewalls extending outwardly from the back panel, an exterior, and an interior having a number of compartments; at least one cover structured to overlay a corresponding one of the compartments, such cover having an open position in which the corresponding one of the compartments is accessible from the exterior of the enclosure, and a closed position in which the corresponding one of the compartments is substantially inaccessible; an operating handle pivotably coupled to the enclosure and being operable among a plurality of positions; and an interlock assembly comprising: a linkage including a first end and a second end, the first end of the linkage being coupled to the operating handle in order that movement of the operating handle results in a corresponding movement of the second end of the linkage, a bracket member including an aperture, the second end of the linkage being receivable by the aperture, and at least one fastening mechanism movably coupling the bracket member to the enclosure. The bracket member is movable between a first position corresponding to the bracket member preventing the second end of the linkage from entering the aperture of the bracket member, thereby resisting undesired movement of the operating handle, and a second position corresponding to the second end of the linkage being receivable by the aperture, in order that the operating handle is movable. When the at least one cover is disposed in the open position, the bracket member is disposed in the first position and, when such cover is disposed in the closed position, the bracket member is disposed in the second position.

The operating handle may have a first end and a second end disposed opposite and distal from the first end. The first end of the operating handle may be pivotably coupled to a corresponding one of the sidewalls of the enclosure. The linkage may be a single rod having a first end and a second end, wherein the first end of the single rod is disposed at or about the first end of the operating handle, and wherein the second end of the single rod extends to the bracket member.

The electrical switching apparatus may be a safety switch, and the operating handle may be operable among an OFF position and at least one ON position. The number of compartments may be a first compartment and a second compartment, wherein the at least one cover is a first door structured to overlay the first compartment and a second door structured to overlay the second compartment. Each of the first door and the second door may have an open position and a closed position, wherein the interlock assembly resists operation of the operating handle from the OFF position to a corresponding one of the at least one ON position when the second door is disposed in the open position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
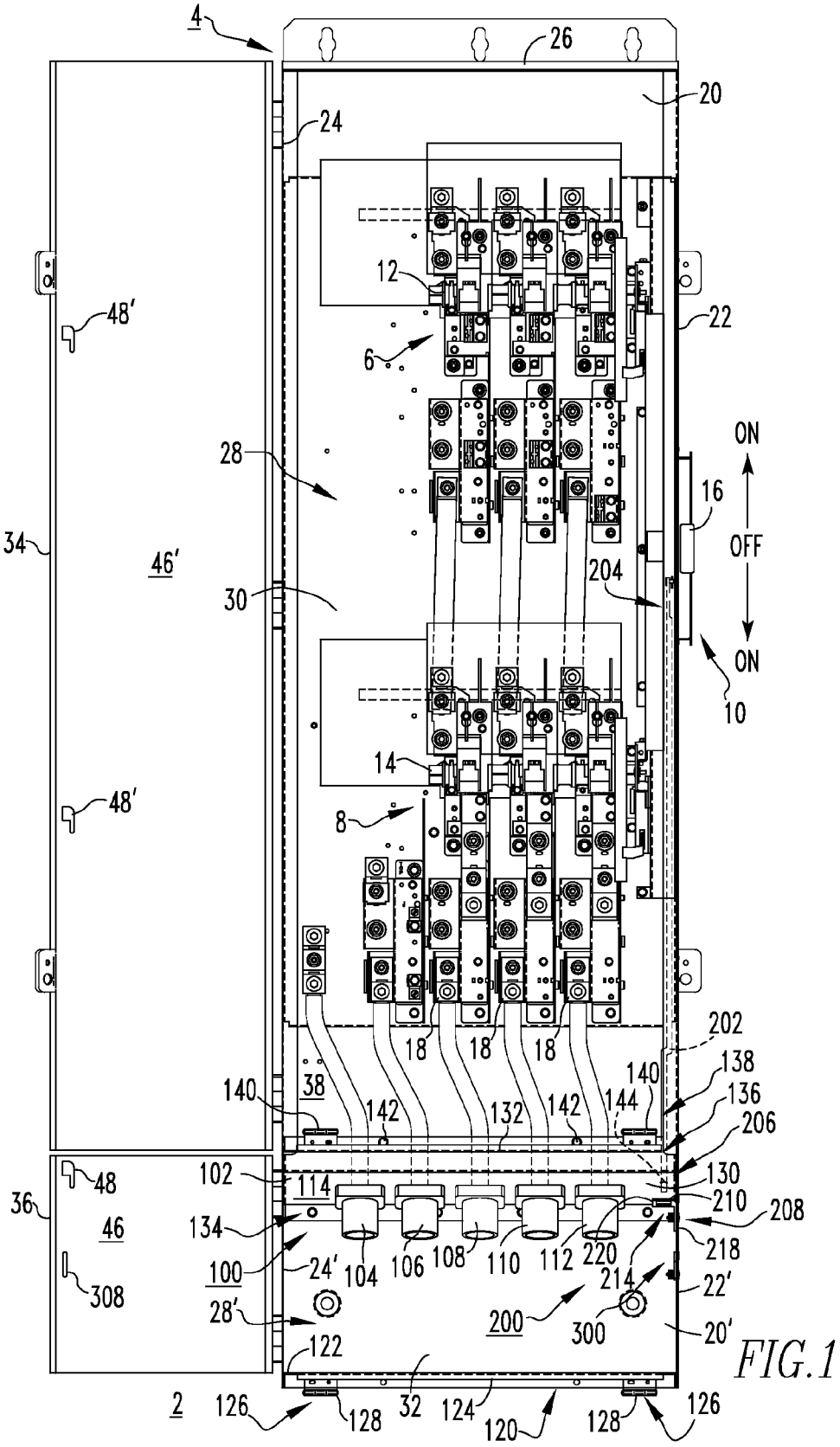
FIG. 1 is a front elevation view of a safety switch and an interlock assembly therefor, in accordance with embodiments of the invention, with the doors of the safety switch enclosure disposed in their open positions to show internal structures.

Directional phrases used herein, such as, for example, left, right, top, bottom, upper, lower, front, back, clockwise, counterclockwise and derivatives thereof, relate to the orientation of the elements shown in the drawings and are not limiting to the claims unless expressly recited therein.

As employed herein, the terms "fastener" and "fastening mechanism" refer to any suitable connecting or tightening material or device expressly including, but not limited to, rivets (e.g., without limitation, pop rivets), screws, bolts and the combinations of bolts and nuts (e.g., without limitation, lock nuts) and bolts, washers (e.g., without limitation, lock washers) and nuts.

As employed herein, the term "linkage" refers to any known or suitable mechanism for interconnecting one component to another component in order to provide mechanical communication therebetween and expressly includes, without limitation, a rigid member, such as a tube, a rod, a shaft, a movable (e.g., without limitation, slidable) plate member, or a link, as well as combinations of a rigid member with a flexible member, such as a cable, a wire, a chain, and an interconnected link or movable plate member.

As employed herein, the term "quick-connect" refers to the ability to relatively rapidly and easily connect one component to another (e.g., without limitation, by only insertion) without requiring a separate tool or numerous (i.e., more than two) steps (e.g., without limitation, insertion and twisting).

As employed herein, the term "quick-connector" refers to any known or suitable connector, receptacle, fastening mechanism or combination thereof which is structured to removably couple one component to another component in a relatively rapid and easy manner, without requiring a separate tool or numerous (i.e., more than two) steps (e.g., without limitation, insertion and twisting) to effectuate the connection, and expressly includes, without limitation, Cam-Lock® connectors and Posi-Lok™ connectors. The quick-connector is also preferably structured to provide relatively rapid and easy disconnecting of the components from one another, without requiring a plurality of separate tools or numerous (i.e., more than two) steps (e.g., without limitation, depressing a release tab and removing; twisting and removing).

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an electrical switching apparatus 2 employing an electrical connector assembly 100 and an interlock assembly 200. The electrical switching apparatus 2 includes an enclosure 4, separable contacts 6,8 housed by the enclosure 4, and an operating mechanism 10 structured to open and close the separable contacts 6,8. In the example shown and described herein, the electrical switching apparatus is a safety switch 2 having a first set of separable contacts 6 and a second set of separable contacts 8, and the operating mechanism 10 includes first and second pole shafts 12,14 structured to open and close the first and second sets of separable contacts 6,8, respectively. The pole shafts 12,14 are coupled to an operating handle 16. The operating mechanism 10 may be substantially similar to that which is described, for example, in U.S. Pat. No. 6,373,009, which is incorporated herein by reference.

Figure 2:
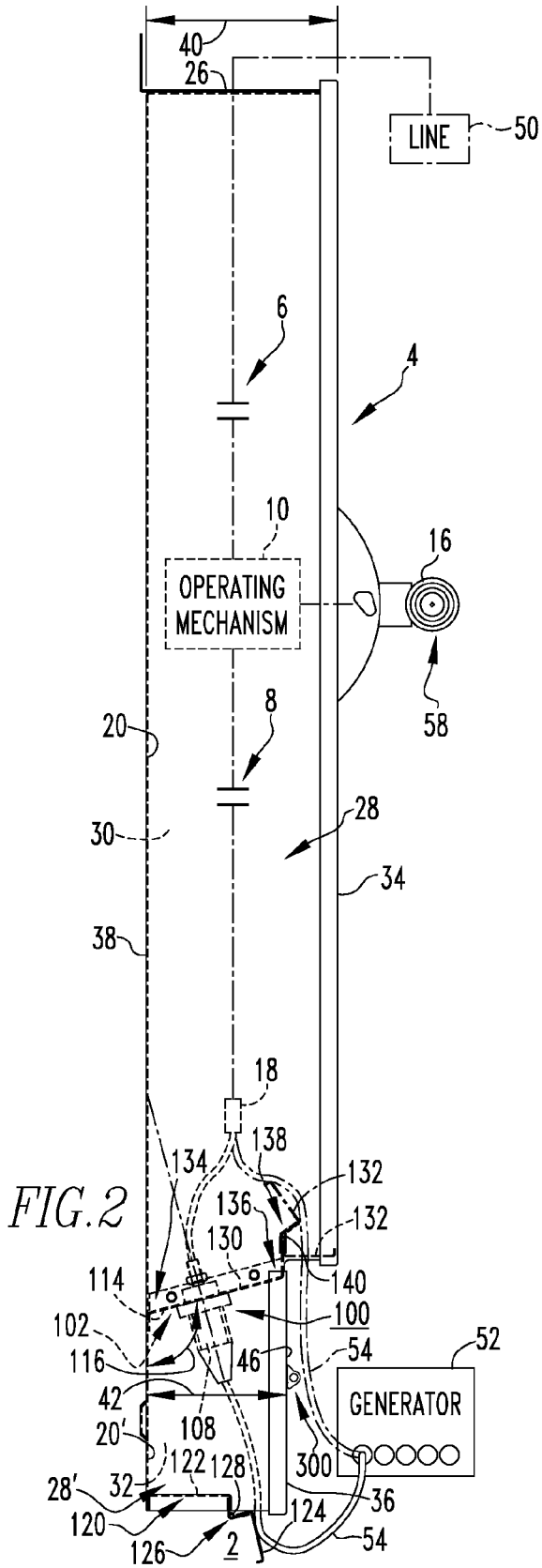
FIG. 2 is a side elevation view of the left side of the safety switch of FIG. 1.

The example operating handle 16 is a double-throw operating handle, which is operable among an OFF position (FIGS. 1-3), a first ON position (not shown) in which the safety switch 2 is electrically connected to a primary power source 50 (shown in phantom line drawing in FIG. 2), and a second ON position (shown in phantom line drawing in FIG. 3) in which the safety switch 2 is electrically connected to a secondary power source such as, for example, the generator 52, shown in FIG. 2. It will, however, be appreciated that the disclosed electrical connector assembly 100 and interlock assembly 200 can be employed with any known or suitable electrical switching apparatus other than the double-throw safety switch 2 shown and described herein. For example and without limitation, the connector assembly 100 and/or the interlock assembly 200 could be suitably adapted for use with an electrical switching apparatus (e.g., without limitation, safety switch) having a single-throw operating handle (not shown) with only one ON position. It will further be appreciated that the disclosed electrical connector assembly 100 and interlock assembly 200 could each be employed with any suitable electrical switching apparatus independently, or in combination.

Figure 3:
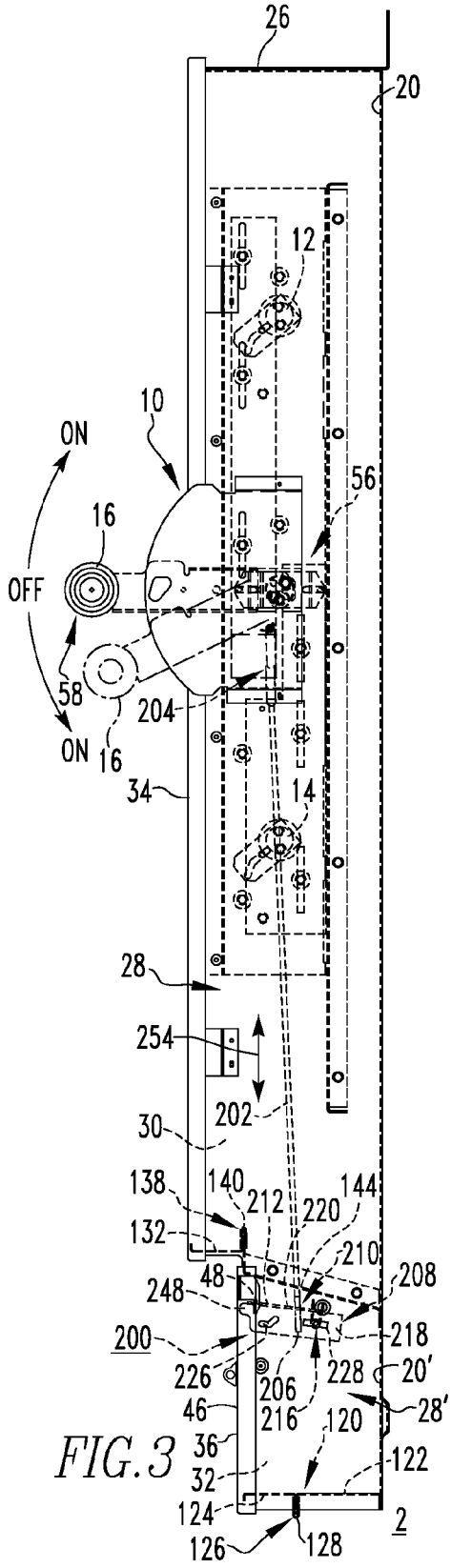
FIG. 3 is a side elevation view of the right side of the safety switch and interlock assembly (shown in hidden line drawing) therefor of FIG. 1.

As shown in FIGS. 1-3, the enclosure 4 has a back panel 20, sidewalls 22,24 (FIG. 1) extending outwardly from the back panel 20, an exterior, an interior 28 having a plurality of compartments 30,32, and at least one cover 34,36 (two covers are shown). The example covers 34,36 are structured to overlay the respective compartments 30,32. The enclosure 4 of the example safety switch 2 has a first compartment 30 and a second compartment 32. The first compartment 30 houses the separable contacts 6,8 (FIGS. 1 and 2) and includes a first cover 34. The second compartment 32 includes a back panel 20', which, in the example shown and described herein, comprises a portion or section of back panel 20, sidewalls 22',24', which, in the example shown and described herein, are portions or sections of sidewalls 22,24, and a second cover 36. In other words, the back panel 20 of the first compartment 30 and the back panel 20' of the second compartment 32 comprise different sections 20,20' of the same piece of material. Likewise, sidewalls 22,24 of first compartment 30 and sidewalls 22',24' of second compartment 32 comprise different sections 22,22' and 24,24', respectively, of the same two pieces of material. The example first and second covers 34,36 are first and second doors pivotably coupled to corresponding sidewalls 24,24' of the first and second compartments 30,32, respectively. It will, however, be appreciated that the enclosure 4 could have any known or suitable alternative number and configuration of compartments and covers therefor. For example and without limitation, rather than being arranged in the over and under configuration, shown in FIGS. 1-3, the first and second compartments 30,32 could alternatively be disposed side-by-side (not shown).

The electrical connector assembly 100 includes a plate member 102 disposed between the first and second compartments 30,32 of the enclosure 4. A plurality of electrical connectors, such as, for example and without limitation, the ground connector 104, neutral connector 106, and three-phase connectors (e.g., without limitation, load connectors; source connectors) 108,110,112, shown in FIG. 1, are coupled to the plate member 102 and electrically connected to the separable contacts 6,8 by way of load terminals 18 (FIGS. 1 and 2). Although three-phase power is shown, the invention is applicable to power sources having any suitable number of phases. The electrical connectors 104,106,108,110,112 are preferably quick-connectors such as, for example and without limitation, Cam-Lock® connectors (FIGS. 1, 2, 4A and 5) and/or Posi-Lok™ connectors (not shown), in order to simplify the connection process, and they are substantially disposed within the second compartment 32. Accordingly, when the second door 36 is overlaying the second compartment 32, as shown in FIGS. 2 and 3, the electrical connectors 104,106, 108,110,112 are substantially inaccessible from the exterior of the enclosure 4. In this manner, the disclosed electrical connector assembly 100 overcomes the disadvantages (e.g., without limitation, inadvertent electrical connection when the safety switch is energized; undesired access to electrical connectors) of known safety switch designs in which electrical connectors are exposed and readily accessible from the exterior of an enclosure.

Figure 4A:
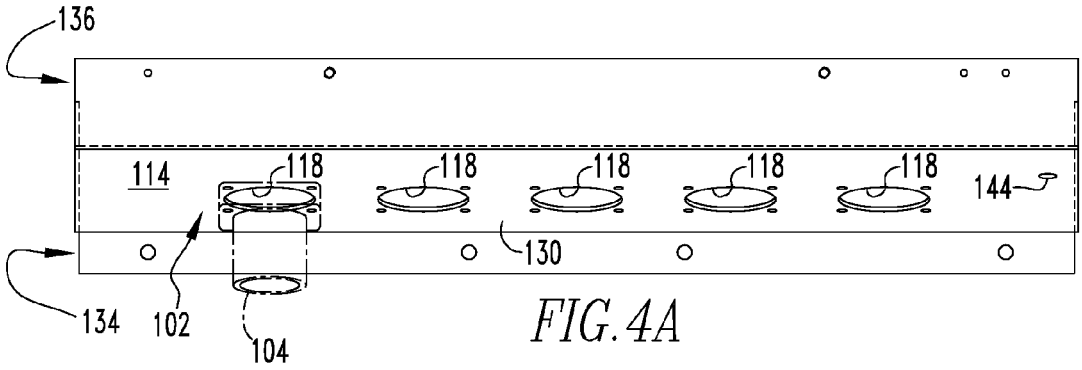
FIGS. 4A and 4B are front elevation and side elevation views, respectively, of the plate member for the electrical safety switch of FIG. 1.
Figure 4B:
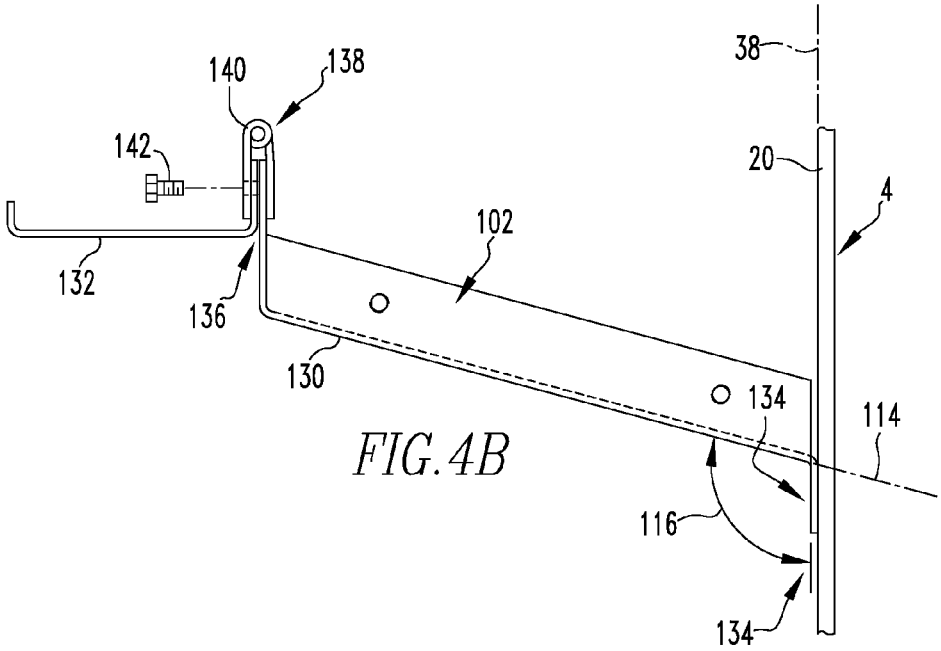

As best shown in the example of FIGS. 2 and 4B, the plate member 102 has a first plane 114 and the back panel 20 of the enclosure 4 has a second plane 38, wherein the first plane 114 is disposed at an angle 116 with respect to the second plane 38. Such angle ranges from about 95 degrees to about 135 degrees. As shown in FIG. 4A, the plate member 102 includes a plurality of apertures 118 that receive the electrical connectors (one electrical connector 104 is shown in phantom line drawing in FIG. 4A). The electrical connectors 104,106,108, 110,112 (FIG. 1) are coupled to the plate member 102 using any known or suitable fastening mechanism, and extend outwardly from the plate member 102 and substantially perpendicularly with respect to the first plane 114 thereof (see, for example, load connector 108 shown in hidden line drawing in FIG. 2).

Referring again to FIGS. 1-3, the second compartment 32 of the enclosure 4 of the example safety switch 2 further includes an end plate 120, which is disposed generally opposite and spaced apart from the plate member 102. At least a portion of the end plate 120 is movable between a closed position (FIGS. 1 and 3) and an open position (FIG. 2). More specifically, the end plate 120 comprises a stationary portion 122, and a movable portion 124 pivotably coupled to the stationary portion 122. Accordingly, when the electrical conductors (e.g., without limitation, cable 54 of FIG. 2) that extend from the secondary power source (e.g., without limitation, generator 52 of FIG. 2) are electrically connected to the electrical connectors 104,106,108,110,112 (for simplicity of disclosure, only one cable 54 is shown connected to the one electrical connector 108 in FIG. 2) of the electrical connector assembly 100, and the second door 36 is overlaying the second compartment 32, the movable portion 124 of the end plate 120 is disposed in the open position and the cables 54 (one cable 54 is shown in FIG. 2 for simplicity of disclosure) extend from within the second compartment 32, between the movable portion 124 of the end plate 120 and the second cover 36, to the exterior of the enclosure 4, as shown in FIG. 2. In this manner, the second door 36 of the second compartment 32 can be closed while maintaining the desired electrical connection to the secondary power source 52.

In the example of FIGS. 1-3, the end plate 120 further includes a spring-loaded hinge 126 having a bias element 128. The spring-loaded hinge 126 pivotably couples the movable portion 124 of the end plate 120 to the stationary portion 122, and the bias element 128 biases the movable portion 124 toward the closed position of FIGS. 1 and 3. In this manner, undesirable access to the interior 28' of the enclosure 4 is substantially prevented.

Referring again to FIG. 4B, the plate member 102 of the electrical connector assembly 100 (FIGS. 1-3) includes a stationary segment 130 and a movable segment 132. The stationary segment 130 has a first end 134 coupled to the back panel 20 (partially shown in FIG. 4B) of the first compartment 30 (FIGS. 1-3) of the enclosure 4, and a second end 136 extending outwardly from such back panel 20. The movable segment 132 is movably coupled at or about the second end 136 of the stationary segment 130. In the example of FIG. 4B, the plate member 102 further includes a hinge assembly 138 having a number of hinges 140 (one hinge 140 is shown in the side elevation view of FIG. 4B; see also the two hinges 140 shown in FIG. 1) and at least one removable fastener 142 (one removable fastener 142 is shown in the side elevation view of FIG. 4B; see also the two removable fasteners 142 shown in FIG. 1). The hinges 140 pivotably couple the stationary and movable segments 130,132, and the removable fastener 142 fastens the movable segment 132 in the closed position shown in FIGS. 1, 2 (hidden line drawing), 3 and 4B. When the removable fastener 142 is removed, the movable portion 132 is pivotable to the open position shown in phantom line drawing in FIG. 2. Accordingly, it will be appreciated that the plate member 102 of the disclosed enclosure 4 provides a mechanism for directly coupling the electrical conductors (e.g., the cable 54) of the secondary power source (e.g., generator 52 of FIG. 2) to the terminals 18 (FIGS. 1 and 2) in the event the electrical connector assembly 100 (FIG. 1-3) of the safety switch 2 has a different type of electrical connector from that of the conductors 54 (FIG. 2) of the secondary power source 52.

More specifically, as shown in FIG. 2, the first compartment 30 of the example enclosure 4 has a first depth 40, and the second compartment 32 has a second depth 42. The first depth 40 is greater than the second depth 42, in order that the movable segment 132 of plate member 102 extends between the second end 136 of the stationary segment 130 of the plate member 102, and the first door 34. Thus, the movable segment 132 is movable between the closed position, shown in hidden line drawing in FIG. 2, and the open position, shown in phantom line drawing in FIG. 2. In the open position, the electrical conductors 54 (only one is shown) of the secondary power source 52 are receivable between the movable segment 132 and the first door 34, as shown in phantom line drawing.

Referring again to FIG. 1, and also to FIGS. 3 and 5, the aforementioned interlock assembly 200 will now be discussed. Specifically, the operating handle 16 of the safety switch 2 has a first end 56 (FIGS. 2 and 3) pivotably coupled to the sidewall 22 of the enclosure 4, and a second end 58 disposed opposite and distal from the first end 56. The interlock assembly 200 includes at least one linkage 202 having a first end 204 (FIGS. 1 and 3) and a second end 206. The first end 204 (FIGS. 1 and 3) is structured to be coupled to the operating handle 16 (FIGS. 1 and 3) of the safety switch 2 (FIGS. 1 and 3) at or about the first end 56 of the operating handle 16, in order that movement of the operating handle 16 (FIGS. 1 and 3) results in a corresponding movement of the second end 206 of the linkage 202. The example linkage is a single-piece rod 202, although it will be appreciated that any known or suitable alternative number and configuration of linkages, as defined herein, could be employed. A bracket member 208, which includes at least one aperture 210,212 (the example bracket member 208 has first and second apertures 210, 212 as best shown in FIG. 6A) is movably coupled to a corresponding one of the sidewalls (e.g., sidewall 22 of FIG. 1) of the enclosure 4 by at least one fastening mechanism 214,216 (best shown in FIG. 6A). The bracket member 208 is movable between a first position (FIGS. 1 and 5) corresponding to the bracket 208 being structured to prevent the second end 206 of the linkage 202 from entering the first aperture 210, thereby resisting undesired movement of the operating handle 16, and a second position (FIG. 3) corresponding to the second end 206 of the linkage 202 being receivable by the first aperture 210 in order that the operating handle 16 is movable. In other words, when the second door 36 (FIGS. 1-3) is disposed in the open position (FIG. 1), the bracket member 208 is disposed in the first position, as shown in FIGS. 1 and 5, and when the second door 36 (FIGS. 1-3) is disposed in the closed position (FIGS. 2-3), the bracket member 208 is disposed in the second position, as shown in FIG. 3.

Figure 5:
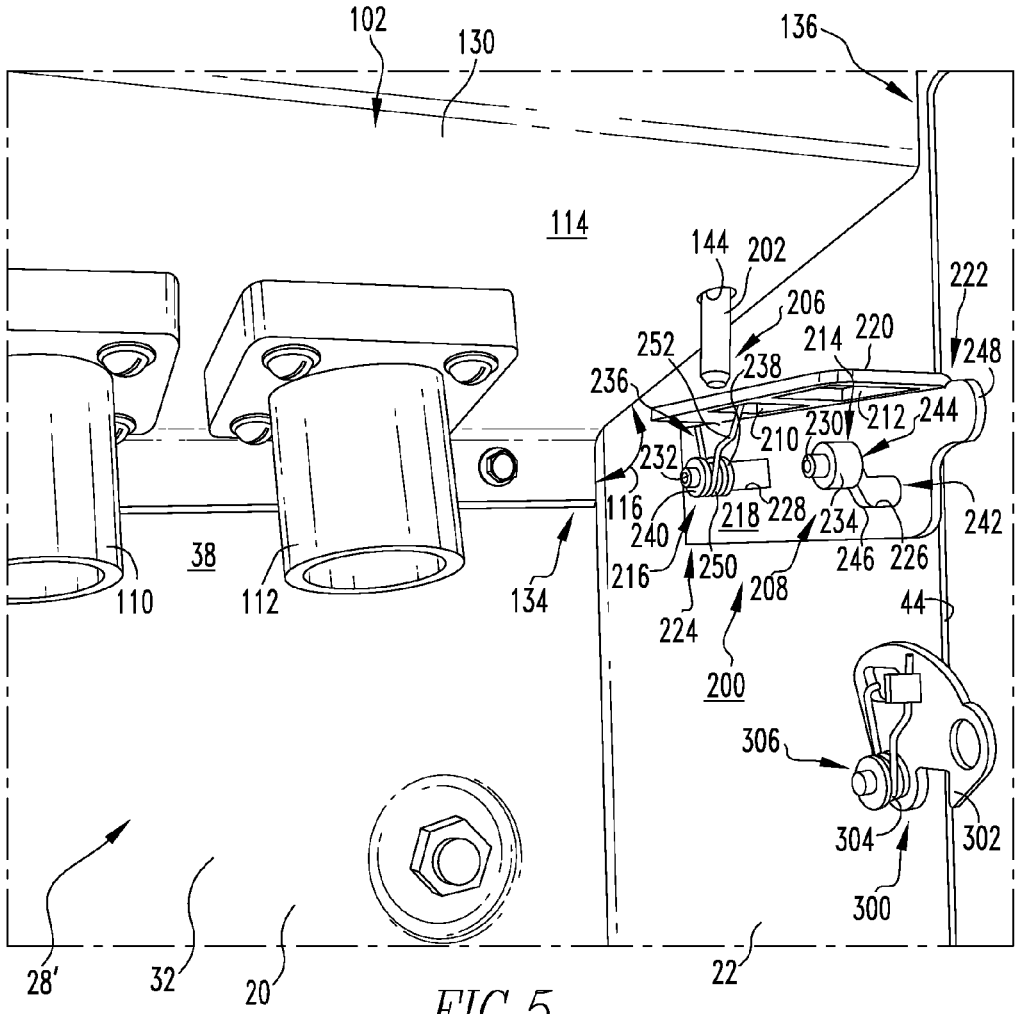
FIG. 5 is an isometric view of a portion of the safety switch and interlock assembly therefor of FIG. 3.
Figure 6A:
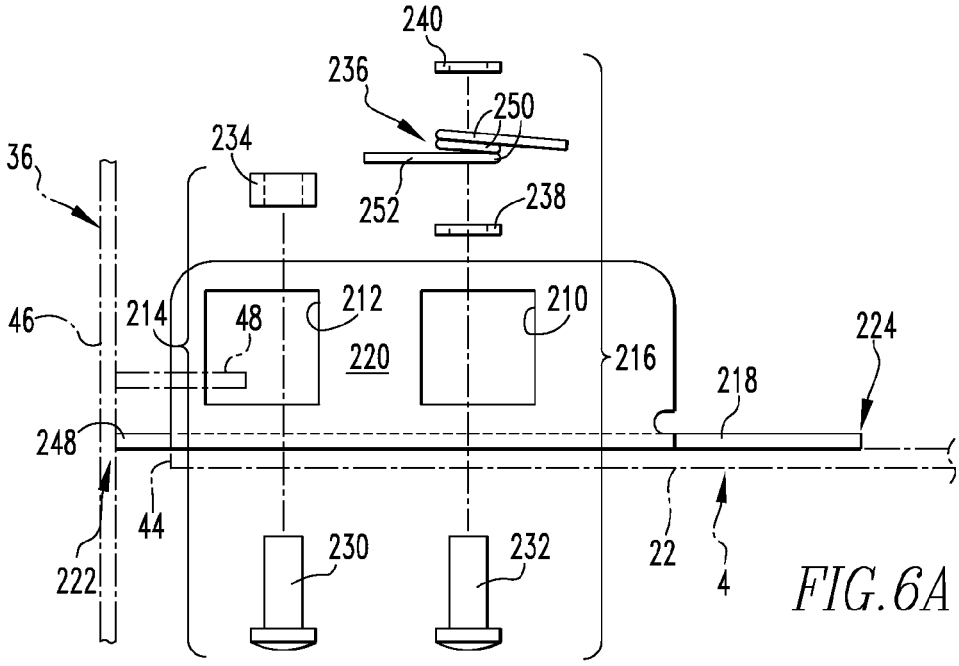
FIGS. 6A and 6B are top plan and side elevation views, respectively, of the bracket member of the interlock assembly of FIG. 5.

As shown in FIGS. 5 and 6A, the bracket member 208 includes a first planar portion 218, which is structured to be substantially parallel with respect to a corresponding sidewall 22 of the enclosure 4, and a second planar portion 220 extending substantially perpendicularly outwardly from the first planar portion 218. The second planar portion 220 of the example bracket member 208 includes the first and second apertures 210,212, and the first planar portion 218 has a first end 222 extending toward the exterior of the enclosure, a second end 224 disposed opposite and distal from the first end 222, and at least one elongated opening 226,228 (FIGS. 5 and 6B) therebetween.

Figure 6B:
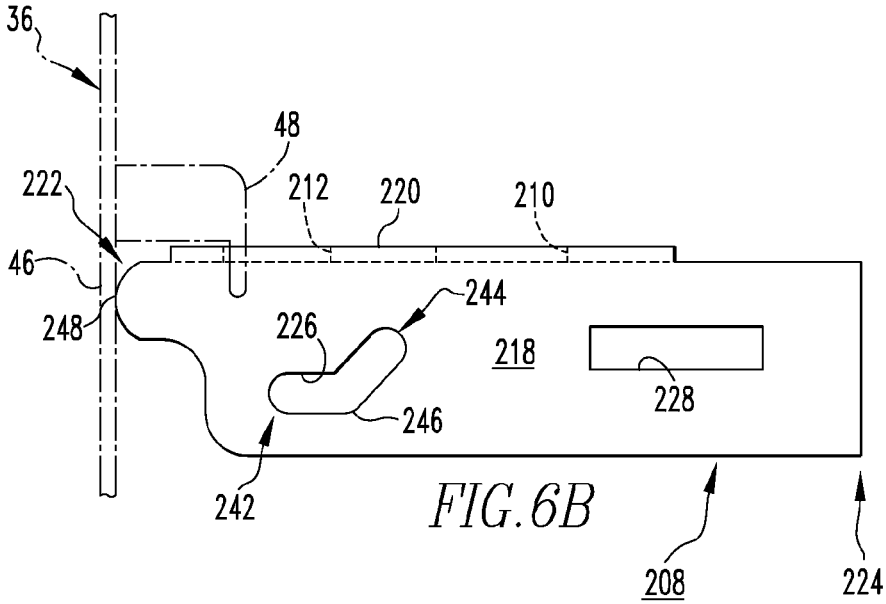

As shown in FIG. 6B, the first planar portion 218 of the example bracket member 208 includes a first elongated slot 226 and a second elongated slot 228 and, as shown in FIG. 6A, the example fastening mechanism comprises a first fastener 214 and a second fastener 216. Each of the first and second fasteners 214,216 includes a shaft 230,232, respectively, which is disposed in a corresponding one of the first elongated slot 226 and the second elongated slot 228, as shown in FIG. 5. Accordingly, when the second door 36 (FIGS. 1-3) of the enclosure 4 is moved from the open position toward the closed position, the bracket member 208 moves with respect to first fastener 214, second fastener 216, and the corresponding sidewall 22 of the enclosure 4, in order to align the first aperture 210 of the bracket member 208 with respect to the second end 206 of the linkage 202, as shown in FIG. 3.

Continuing to refer to FIG. 6A, it will be appreciated that the first fastener 214, which in the example shown and described herein is a rivet, further includes a retention element 234 (e.g., without limitation, a bushing; a washer). As shown in FIG. 5, the shaft 230 of the first fastener 214 extends outwardly from the sidewall 22 of the enclosure 4, through the first elongated slot 226, and beyond the first planar portion 218 of the bracket member 208. The retention element 234 is then coupled to the shaft 230 of the first fastener 214 proximate the first planar portion 218 in order to retain the bracket member 208 on the shaft 230. Similarly, the shaft 232 of the second fastener 216 extends outwardly from sidewall 22, through the second elongated slot 228, and beyond the first planar portion 218 of the bracket member 208. However, the second fastener 216 further includes a bias member, such as the spring 236 shown in FIG. 5. The spring 236 is disposed on the shaft 232 of second fastener 216 between a pair of retention elements 238,240. More specifically, the spring 236 includes a number of coils 250 and a biasing arm 252. The coils 250 of the spring 236 are received by the shaft 232 of the second fastener 216, and the biasing arm 252 engages the first aperture 210 of the bracket member 218, thereby biasing the bracket member 208 toward the first position, as shown in FIG. 5. It will, however, be appreciated that any known or suitable alternative fastening mechanism, as defined herein, could be employed in any suitable alternative configuration, without departing from the scope of the invention.

As best shown in FIG. 6B, the first elongated slot 226 includes a first end 242, a second end 244, and a turn 246 between the first and second ends 242,244. In this manner, the bracket member 208 is capable of both pivoting and sliding with respect to the fastening mechanisms 214,216 (FIGS. 5 and 6A) and sidewall 22 (FIGS. 5 and 6A) of the enclosure 4 (FIGS. 5 and 6A). More specifically, the sidewall 22 of enclosure 4 has an edge 44 (FIG. 5), and the first end 222 of the first planar portion 218 of bracket member 208 includes a protrusion 248 structured to be engaged and moved by the second door 36 (FIGS. 1-3) of the enclosure 4. When the bracket member 208 is disposed in the first position, shown in FIG. 5, the protrusion 248 extends beyond the edge 44. When the second door 36 (FIGS. 1-3) of the enclosure 4 is disposed in the closed position, and the second end 206 of the linkage 202 is disposed in the first aperture 210, as shown in FIG. 3, the second aperture 212 is structured to receive a portion of the second door 36 (best shown in phantom line drawing in FIGS. 6A and 6B), in order to fasten it closed. In particular, the example second door 36 includes a panel member 46 and a protrusion 48 extending generally perpendicularly outwardly therefrom. The protrusion 48, which in the example shown and described herein comprises a latch, engages the bracket member 208 at the second aperture 212 of the bracket member 208 of the disclosed interlock assembly 200 when the second door 36 is closed, as shown in FIG. 3. In this manner, the second door 36 is fastened in the closed position when the operating handle 16 of the safety switch 2 is operable to the second ON position (shown in phantom line drawing in FIG. 3).

Accordingly, it will be appreciated that the disclosed interlock assembly 200 resists operation of the operating handle 16 from the intermediate OFF position to the second ON position (shown in phantom line drawing in FIG. 3) when the second door 36 is disposed in the open position (FIG. 1). In doing so, the linkage 202 of the interlock assembly 200 moves in the direction generally indicated by arrow 254 in FIG. 3, as it extends from proximate the first end 56 of the operating handle 16 in the first compartment 30 of enclosure 4, through an opening 144 in plate member 102, and into the second compartment 32 to the bracket member 208 disposed therein.

It will be appreciated that the first door 34 of the enclosure 4 could include a separate panel member 46' having a suitable number of protrusions 48' (e.g., without limitation, latches), as shown in FIG. 1. It will also be appreciated that the enclosure 4 could optionally additionally include one or more door latch assemblies, such as the spring-loaded door latch assembly 300 shown in FIG. 5, to provide a mechanism for locking the second door 36 of the enclosure 4 in the closed position. The example spring-loaded door latch assembly 300 includes a latch 302 pivotably coupled to sidewall 22 of the enclosure 4 by fastener 306, and a spring 304. The latch 302 is biased by spring 304 toward the position shown in FIG. 5, and is structured to extend through the opening 308 (FIG. 1) of second door 36 when the door is closed, as shown in FIG. 2. A padlock (not shown) or other suitable locking mechanism (not shown) can then be inserted through the hole in the latch 302, for example, to lock the second door 36 shut and further prevent undesired access to the interior of the second compartment 32 of the enclosure 4.

It will, therefore, be appreciated that the disclosed electrical connector assembly 100 and interlock assembly 200 provide mechanisms which can be employed independently or in combination to resist undesired access to the interior 28' of the safety switch enclosure 4 and components housed therein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An interlock assembly for an electrical switching apparatus including an enclosure and an operating handle, said enclosure having a plurality of sidewalls, an interior, an exterior, and at least one cover, said at least one cover having an open position in which the interior of said enclosure is accessible from the exterior of said enclosure, and a closed position in which the interior of said enclosure is substantially inaccessible, said operating handle being operable among a plurality of positions, said interlock assembly comprising:

a linkage including a first end and a second end, the first end of said linkage being structured to be coupled to said operating handle in order that movement of said operating handle results in a corresponding movement of the second end of said linkage;

a bracket member including an aperture, said aperture being structured to receive the second end of said linkage; and at least one fastening mechanism structured to movably couple said bracket member to said enclosure, wherein said bracket member is movable between a first position corresponding to said bracket member being structured to prevent the second end of said linkage from entering said aperture of said bracket member in order to resist undesired movement of said operating handle, and a second position corresponding to the second end of said linkage being structured to be receivable by said aperture in order that said operating handle is movable, wherein, when said at least one cover is disposed in said open position, said bracket member is disposed in said first position, and wherein, when said at least one cover is disposed in said closed position, said bracket member is disposed in said second position.

2. The interlock assembly of claim 1 wherein said bracket member comprises a first planar portion structured to be substantially parallel with respect to a corresponding one of said sidewalls of said enclosure, and a second planar portion extending substantially perpendicularly outwardly from said first planar portion and being structured to extend substantially perpendicularly outwardly with respect to said corresponding one of said sidewalls of said enclosure; and wherein said aperture of said bracket member is disposed in said second planar portion.

3. The interlock assembly of claim 2 wherein said first planar portion has a first end structured to extend toward the exterior of said enclosure, a second end disposed opposite and distal from the first end, and at least one elongated opening disposed between the first end and the second end; and wherein said at least one elongated opening is structured to receive a corresponding one of said at least one fastening mechanism.

4. The interlock assembly of claim 3 wherein said at least one elongated opening is a first elongated slot and a second elongated slot; wherein said at least one fastening mechanism is a first fastener and a second fastener; wherein each of said first fastener and said second fastener comprises a shaft; wherein said shaft of said first fastener is disposed in said first elongated slot and said shaft of said second fastener is disposed in said second elongated slot; and wherein, when said at least one cover of said enclosure is moved from said open position toward said closed position, said bracket member is structured to move with respect to said first fastener, said second fastener, and said corresponding one of said sidewalls of said enclosure in order to align said aperture of said bracket member with respect to the second end of said linkage.

5. The interlock assembly of claim 4 wherein said first fastener further comprises a retention element; wherein said shaft of said first fastener is structured to extend outwardly from said corresponding one of said sidewalls of said enclosure, through said first elongated slot, and beyond said second planar portion of said bracket member; wherein said retention element of said first fastener is coupled to said shaft of said first fastener proximate said second planar portion of said bracket member in order to retain said bracket member on said shaft of said first fastener; wherein said second fastener further comprises a bias member and at least one retention element; wherein said shaft of said second fastener is structured to extend outwardly from said corresponding one of said sidewalls of said enclosure, through said second elongated slot, and beyond said second planar portion of said bracket member; wherein said bias member of said second fastener is disposed on said shaft of said second fastener; and wherein said at least one retention element of said second fastener is coupled to said shaft of said second fastener proximate said bias member in order to retain said bias member and said bracket member on said shaft of said second fastener.

6. The interlock assembly of claim 3 wherein at least one of said at least one elongated opening includes a first end, a second end, and a turn between the first end and the second end, in order that said bracket member is structured to pivot and slide with respect to said at least one fastening mechanism.

7. The interlock assembly of claim 3 wherein said corresponding one of said sidewalls of said enclosure has an edge; wherein the first end of said first planar portion of said bracket member includes a protrusion; wherein, when said bracket member is disposed in said first position, said protrusion is structured to extend beyond said edge of said corresponding one of said sidewalls of said enclosure; and wherein, when said at least one cover of said enclosure is moved from said open position toward said closed position, said protrusion and said bracket member are structured to be moved by said at least one cover from said first position toward said second position.

8. The interlock assembly of claim 1 wherein said aperture of said bracket member is a first aperture; wherein said bracket member further includes a second aperture; wherein said first aperture is structured to receive the second end of said linkage; and wherein, when said at least one cover of said enclosure is disposed in said closed position and the second end of said at least one linkage is disposed in said first aperture, said second aperture is structured to receive a portion of said at least one cover in order to fasten said at least one cover in said closed position.

9. The interlock assembly of claim 1 wherein at least one of said at least one fastening mechanism includes a bias member and a fastener having a shaft; wherein said bias member comprises a number of coils and a biasing arm; wherein said shaft of said fastener is disposed through said coils; and wherein said biasing arm engages said aperture of said bracket member, thereby biasing said bracket member toward said first position.

10. The interlock assembly of claim 1 wherein said at least one linkage is a single rod structured to extend from proximate said operating handle to said bracket member.

11. An electrical switching apparatus comprising:

an enclosure including a back panel, sidewalls extending outwardly from said back panel, an exterior, and an interior having a number of compartments;

at least one cover structured to overlay a corresponding one of said compartments, said at least one cover having an open position in which said corresponding one of said compartments is accessible from the exterior of said enclosure, and a closed position in which said corresponding one of said compartments is substantially inaccessible;

an operating handle pivotably coupled to said enclosure and being operable among a plurality of positions; and an interlock assembly comprising:

a linkage including a first end and a second end, the first end of said linkage being coupled to said operating handle in order that movement of said operating handle results in a corresponding movement of the second end of said linkage, a bracket member including an aperture, the second end of said linkage being receivable by said aperture, and at least one fastening mechanism movably coupling said bracket member to said enclosure, wherein said bracket member is movable between a first position corresponding to said bracket member preventing the second end of said linkage from entering said aperture of said bracket member, thereby resisting undesired movement of said operating handle, and a second position corresponding to the second end of said linkage being receivable by said aperture, in order that said operating handle is movable, wherein, when said at least one cover is disposed in said open position, said bracket member is disposed in said first position, and wherein, when said at least one cover is disposed in said closed position, said bracket member is disposed in said second position.

12. The electrical switching apparatus of claim 11 wherein said bracket member comprises a first planar portion disposed substantially parallel with respect to a corresponding one of said sidewalls of said enclosure, and a second planar portion extending substantially perpendicularly outwardly from said first planar portion; wherein said aperture of said bracket member is disposed in said second planar portion; and wherein said first planar portion has a first end extending toward the exterior of said enclosure, a second end disposed opposite and distal from the first end, and at least one elongated opening disposed between the first end and the second end.

13. The electrical switching apparatus of claim 12 wherein said at least one elongated opening is a first elongated slot and a second elongated slot; wherein said at least one fastening mechanism is a first fastener and a second fastener; wherein each of said first fastener and said second fastener comprises a shaft; wherein said shaft of said first fastener is disposed in said first elongated slot and said shaft of said second fastener is disposed in said second elongated slot; and wherein, when said at least one cover of said enclosure is moved from said open position toward said closed position, said bracket member moves with respect to said first fastener, said second fastener, and said corresponding one of said sidewalls of said enclosure in order to align said aperture of said bracket member with respect to the second end of said linkage.

14. The electrical switching apparatus of claim 12 wherein said corresponding one of said sidewalls of said enclosure has an edge; wherein the first end of said first planar portion of said bracket member includes a protrusion; wherein, when said bracket member is disposed in said first position, said protrusion extends beyond said edge of said corresponding one of said sidewalls of said enclosure; and wherein, when said at least one cover of said enclosure is moved from said open position toward said closed position, said at least one cover moves said protrusion and said bracket member from said first position toward said second position.

15. The electrical switching apparatus of claim 14 wherein at least one of said at least one elongated opening includes a first end, a second end, and a turn between the first end and the second end, in order that said bracket member is pivotable and slidable with respect to said corresponding one of said sidewalls of said enclosure and said at least one fastening mechanism.

16. The electrical switching apparatus of claim 11 wherein said at least one cover comprises a panel member and a protrusion extending outwardly from said panel member toward the interior of said enclosure; wherein said aperture of said bracket member is a first aperture; wherein said bracket member further includes a second aperture; wherein the second end of said linkage is receivable in said first aperture; and wherein, when said at least one cover of said enclosure is disposed in said closed position and the second end of said linkage is disposed in said first aperture, said protrusion of said at least one cover is received by said second aperture in order to fasten said at least one cover in said closed position.

17. The electrical switching apparatus of claim 11 wherein at least one of said at least one fastening mechanism includes a bias member and a fastener having a shaft; wherein said bias member comprises a number of coils and a biasing arm; wherein said shaft of said fastener is disposed through said coils; and wherein said biasing arm engages said aperture of said bracket member, thereby biasing said bracket member toward said first position.

18. The electrical switching apparatus of claim 11 wherein said operating handle has a first end and a second end disposed opposite and distal from the first end; wherein the first end of said operating handle is pivotably coupled to a corresponding one of said sidewalls of said enclosure; wherein said linkage is a single rod having a first end and a second end; wherein the first end of said single rod is disposed at or about the first end of said operating handle; and wherein the second end of said single rod extends to said bracket member.

19. The electrical switching apparatus of claim 18 wherein said electrical switching apparatus is a safety switch; wherein said operating handle is operable among an OFF position and at least one ON position; wherein said number of compartments is a first compartment and a second compartment; wherein said at least one cover is a first door structured to overlay said first compartment and a second door structured to overlay said second compartment; wherein each of said first door and said second door has an open position and a closed position; and wherein said interlock assembly resists operation of said operating handle from said OFF position to a corresponding one of said at least one ON position when said second door is disposed in said open position.

20. The electrical switching apparatus of claim 19 wherein said operating handle is disposed at or about said first compartment; wherein said bracket member is disposed in said second compartment; wherein said enclosure includes a plate member disposed between said first compartment and said second compartment; wherein said plate member includes a hole; and wherein the second end of said single rod is receivable through the hole of said plate member in order to extend from said first compartment into said second compartment.

* * * * *